US007607389B2

(12) United States Patent
Stadlmair et al.

(10) Patent No.: US 7,607,389 B2
(45) Date of Patent: Oct. 27, 2009

(54) APPARATUS AND METHOD FOR APPLYING A DAMPING SOLUTION ONTO A FORM CYLINDER OF A PRESS UNIT

(75) Inventors: Anton Stadlmair, Kuehbach (DE); Helmut Stuhlmiller, Altenmuenster (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 561 days.

(21) Appl. No.: 11/242,429

(22) Filed: Sep. 29, 2005

(65) Prior Publication Data

US 2006/0225588 A1 Oct. 12, 2006

(30) Foreign Application Priority Data

Sep. 29, 2004 (DE) ..... 10 2004 047 168

(51) Int. Cl.

| | |
|---|---|
| ***B41L 25/02*** | (2006.01) |
| ***B41L 25/16*** | (2006.01) |
| ***B41L 25/18*** | (2006.01) |
| ***B41F 7/26*** | (2006.01) |
| ***B41F 7/40*** | (2006.01) |

(52) U.S. Cl. ..... 101/147; 101/148

(58) Field of Classification Search ..... 101/147
See application file for complete search history.

(56) References Cited

U.S. PATENT DOCUMENTS 4,922,818 A * 5/1990 Junghans ..... 101/148
5,086,696 A 2/1992 Junghans
5,090,314 A 2/1992 Miescher et al.

FOREIGN PATENT DOCUMENTS

| | | |
|---|---|---|
| DE | 28 45 932 | 4/1980 |
| DE | 87 16 847 U1 | 2/1988 |
| DE | 40 11 039 C2 | 10/1991 |
| DE | 195 20 841 A1 | 12/1996 |
| DE | 694 20 996 T2 | 3/2000 |
| EP | 0 478 493 A1 | 4/1992 |
| GB | 2 259 056 A | 3/1993 |

* cited by examiner

*Primary Examiner*—Judy Nguyen
*Assistant Examiner*—Joshua D. Zimmerman
(74) *Attorney, Agent, or Firm*—Crowell & Moring LLP

(57) ABSTRACT

A printing unit having a press unit is disclosed. Damping solution is applied to a form cylinder by way of direct damping-solution supply via a damping unit in such a way that a damping-solution applicator roll which is set away from an ink distributor roll and is driven by way of friction by the form cylinder rolls only on the form cylinder and thus applies the damping solution to the form cylinder only directly via the damping-solution applicator roll. In the event of indirect damping-solution supply in which the damping-solution applicator roll rolls exclusively on the ink distributor roll and is driven by way of friction by the ink distributor roll, in order to switch over to direct damping-solution supply, the damping-solution applicator roll is set away from the ink distributor roll more quickly than the damping unit, and thus the damping-solution applicator roll, is set against the form cylinder.

9 Claims, 4 Drawing Sheets

APPARATUS AND METHOD FOR APPLYING A DAMPING SOLUTION ONTO A FORM CYLINDER OF A PRESS UNIT

This application claims the priority of German Patent Document No. 10 2004 047 168.1, filed Sep. 29, 2004, the disclosure of which is expressly incorporated by reference herein.

BACKGROUND AND SUMMARY OF THE INVENTION

The invention relates to a printing unit of a printing press.

Printing units of web-fed rotary presses, in particular of newspaper presses, have a plurality of press units, every press unit comprising a transfer cylinder, a form cylinder and an inking unit and damping unit. Furthermore, printing units of this type can have impression cylinders, it being possible for an impression cylinder to interact with one or more transfer cylinders of different press units. In addition to printing units which have impression cylinders of this type, printing units which do not have any impression cylinders are also known, the transfer cylinders of two press units rolling on one another in printing units of this type without impression cylinders. Rubber blankets are usually clamped on the transfer cylinders and printing plates on the form cylinders, for which reason the transfer cylinders are also called rubber-covered cylinders and the form cylinders are also called plate cylinders. The inking unit of a press unit serves to apply printing ink onto the form cylinder of the press unit, whereas the damping unit serves to apply a damping solution onto the form cylinder of the press unit.

In web-fed rotary presses, a distinction is made in principle between printing units which apply the damping solution onto the form cylinder of the respective press unit via direct damping-solution supply or via indirect damping-solution supply. In press units having indirect damping-solution supply, a damping-solution applicator roll of the damping unit rolls firstly on the form cylinder and secondly on an ink distributor roll of the inking unit of the respective press unit, the damping solution being applied to the form cylinder firstly directly via the damping-solution applicator roll and secondly indirectly via ink applicator rolls of the inking unit. In press units of this type having indirect damping-solution supply, the damping-solution applicator roll is driven by way of friction by the ink distributor roll. In contrast, in press units having direct damping-solution supply, the damping-solution applicator roll rolls only on the form cylinder and not on the ink distributor roll, with the result that the damping solution passes to the form cylinder only directly via the damping-solution applicator roll. In press units having direct damping-solution supply, the damping-solution applicator roll is either assigned a dedicated drive or the damping-solution applicator roll is driven mechanically via a gear mechanism. Printing units or press units of printing units of this type have not been disclosed up to now which also make direct damping-solution supply possible in the event of a machine-side design for indirect damping-solution supply and accordingly in the event of a damping-solution applicator roll without a dedicated drive or without an associated gear mechanism.

Proceeding from this, the present invention is based on the problem of providing a novel printing unit of a printing press.

By way of the printing unit according to the invention, the damping solution can, furthermore, be applied via direct damping-solution supply, in addition to indirect damping-solution supply, in such a way that the damping-solution applicator roll which is set away from the ink distributor roll and is driven by way of friction by the form cylinder rolls only on the form cylinder and thus applies the damping solution to the form cylinder only directly via the damping-solution applicator roll, it being possible, in the event of indirect damping-solution supply, which is selected by the controller or the machine and in the print set-up mode in which the damping-solution applicator roll rolls exclusively on the ink distributor roll and is driven by way of friction by the ink distributor roll, to set the damping-solution applicator roll away from the ink distributor roll of the inking unit more quickly in order to switch over to direct damping-solution supply than it is possible to set the damping unit and thus the damping-solution applicator roll against the form cylinder.

Accordingly, firstly indirect damping-solution supply and secondly direct damping-solution supply in the event of a damping-solution applicator roll which is driven only by way of friction are possible using the printing unit according to the invention, without there being a risk of damaging the damping-solution applicator roll during the switchover from indirect damping-solution supply to direct damping-solution supply. A dedicated drive for the damping-solution applicator roll or a gear mechanism which is assigned to the damping-solution applicator roll can be dispensed with.

BRIEF DESCRIPTION OF THE DRAWINGS

Preferred developments of the invention result from the following description. Without being restricted thereto, exemplary embodiments of the invention will be explained in greater detail using the drawings.

DETAILED DESCRIPTION OF THE DRAWINGS

Figure 1:
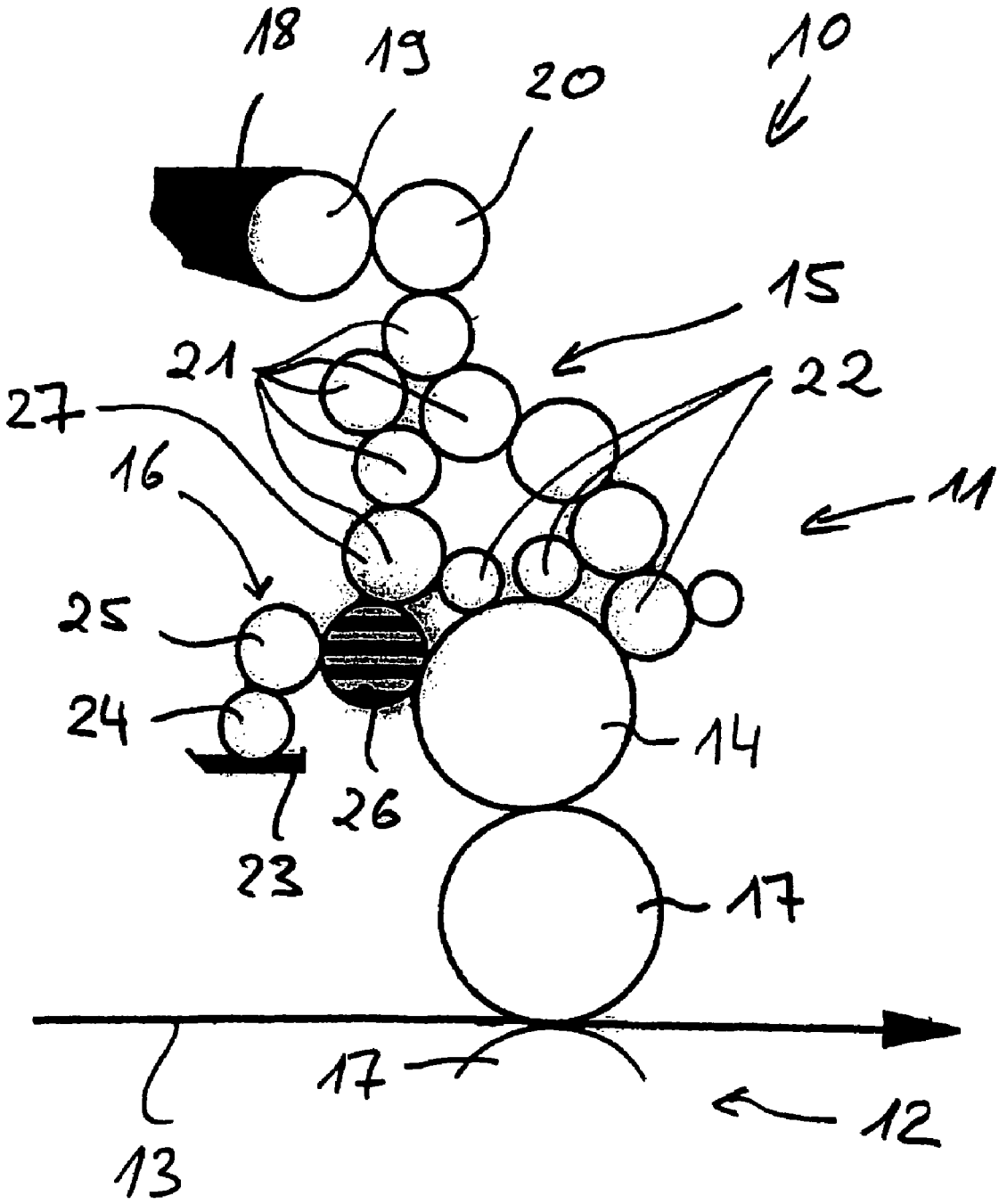
FIG. 1 shows a diagrammatic illustration of a printing unit according to the invention in printing operation with indirect damping-solution supply.

FIG. 1 shows a diagrammatic detail of a printing unit 10 according to the invention which has two press units 11 and 12 for printing both sides of a web-shaped printing material 13. FIG. 1 shows only the press unit 11 which is responsible for printing the upper side of the web-shaped printing material 13.

As can be gathered from FIG. 1, the press units 11 and 12 of the printing unit 10 have in each case one form cylinder or plate cylinder 14, printing plates (not shown) being arranged on the form cylinder 14. Printing ink can be applied to the form cylinder 14 via an inking unit 15; in contrast, damping solution can be applied to the form cylinder 14 via a damping unit 16. The printing ink passes from the form cylinder 14 via a transfer cylinder or rubber-covered cylinder 17 finally to the printing material which is to be printed.

FIG. 1 shows that the inking unit 15 has an ink fountain 18, in which printing ink is kept ready. The printing ink passes from the ink fountain 18 via a ductor roll 19 and a film roll 20 which interacts with the ductor roll 19 to inking rolls 21 of the inking unit 15. The inking rolls 21 transfer the printing ink successively to ink applicator rolls 22 which roll on the surface of the form cylinder 14.

The damping unit 16 has a reservoir 23 for damping solution, the damping solution which is kept ready in the reservoir 23 being removed from the reservoir 23 via a removal roll 24 and passing via a chromium-plated roll 25 which rolls on the removal roll 24 to a damping-solution applicator roll 26 which, in the state shown in FIG. 1, rolls firstly on the form cylinder 14 and secondly on an inking roll 21 of the inking unit 15, this inking roll 21 also being referred to as an ink distributor roll 27.

In FIG. 1, the press unit 11 is in printing operation with what is known as indirect damping-solution supply, the damping solution passing in the case of indirect damping-solution supply firstly directly via the damping-solution applicator roll 26 to the form cylinder 14, and secondly being applied indirectly to the form cylinder 14 via the ink applicator rolls 22 as a result of the contact between the damping-solution applicator roll 26 and the ink distributor roll 27.

In a press unit of this type with indirect damping-solution supply, the damping-solution applicator roll 26 is driven in printing operation exclusively by way of friction by the ink distributor roll 27. Accordingly, the damping-solution applicator roll 26 has no dedicated drive. Furthermore, the damping-solution applicator roll 26 is not assigned a gear mechanism. Accordingly, the damping-solution applicator roll 26 is driven exclusively by the ink distributor roll 27 by way of friction with the ink distributor roll 27.

Figure 2:
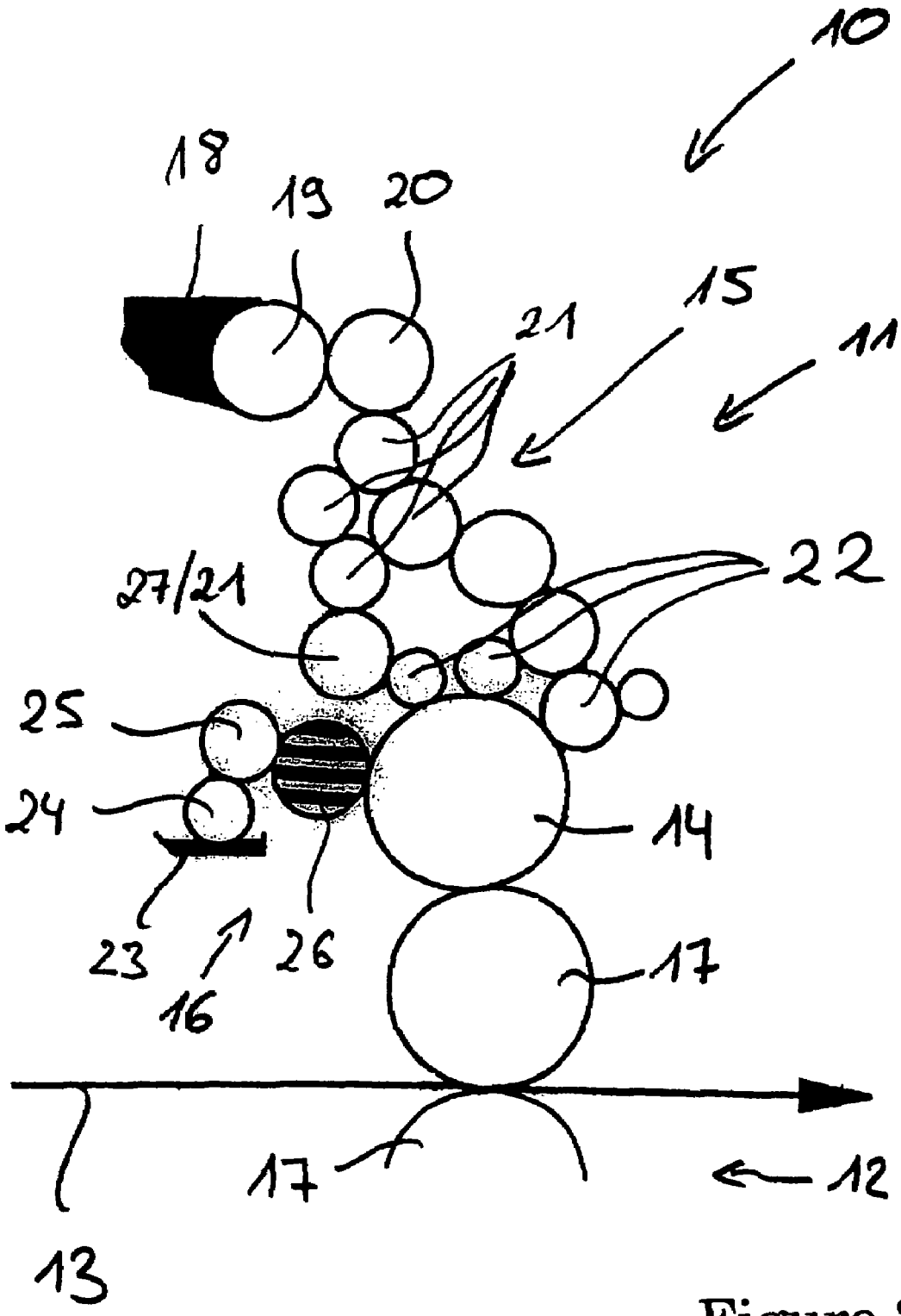
FIG. 2 shows a diagrammatic illustration of the printing unit according to the invention in printing operation with direct damping-solution supply.

In terms of the present invention, a printing unit 10 is then provided, the press units of which have a damping-solution applicator roll 26 which is driven only by friction for indirect damping-solution supply, it being possible, however, to switch the press units over to direct damping-solution supply. FIG. 2 shows the printing unit 10 according to the invention in the state of direct damping-solution supply in printing operation, in which the damping-solution applicator roll 26 is set away from the ink distributor roll 27 and accordingly rolls exclusively on the form cylinder 14. In direct damping-solution supply in the case of the printing unit according to the invention, the damping-solution applicator roll 26 is driven exclusively by way of friction by the form cylinder 14.

In order then to ensure a switchover between indirect damping-solution supply (see FIG. 1) and direct damping-solution supply (see FIG. 2) without the damping-solution applicator roll 26 being damaged in the switchover in the printing unit 10 according to the invention, the damping-solution applicator roll 26 of which is driven exclusively by friction, it is provided in terms of the present invention, when indirect damping-solution supply is selected by the controller or the machine in the print set-up mode, to set the damping-solution applicator roll 26 away from the ink distributor roll 27 more quickly in order to switch over to direct damping-solution supply than the damping unit 16 or the damping-solution applicator roll 26 is set against the form cylinder 14.

Figure 3:
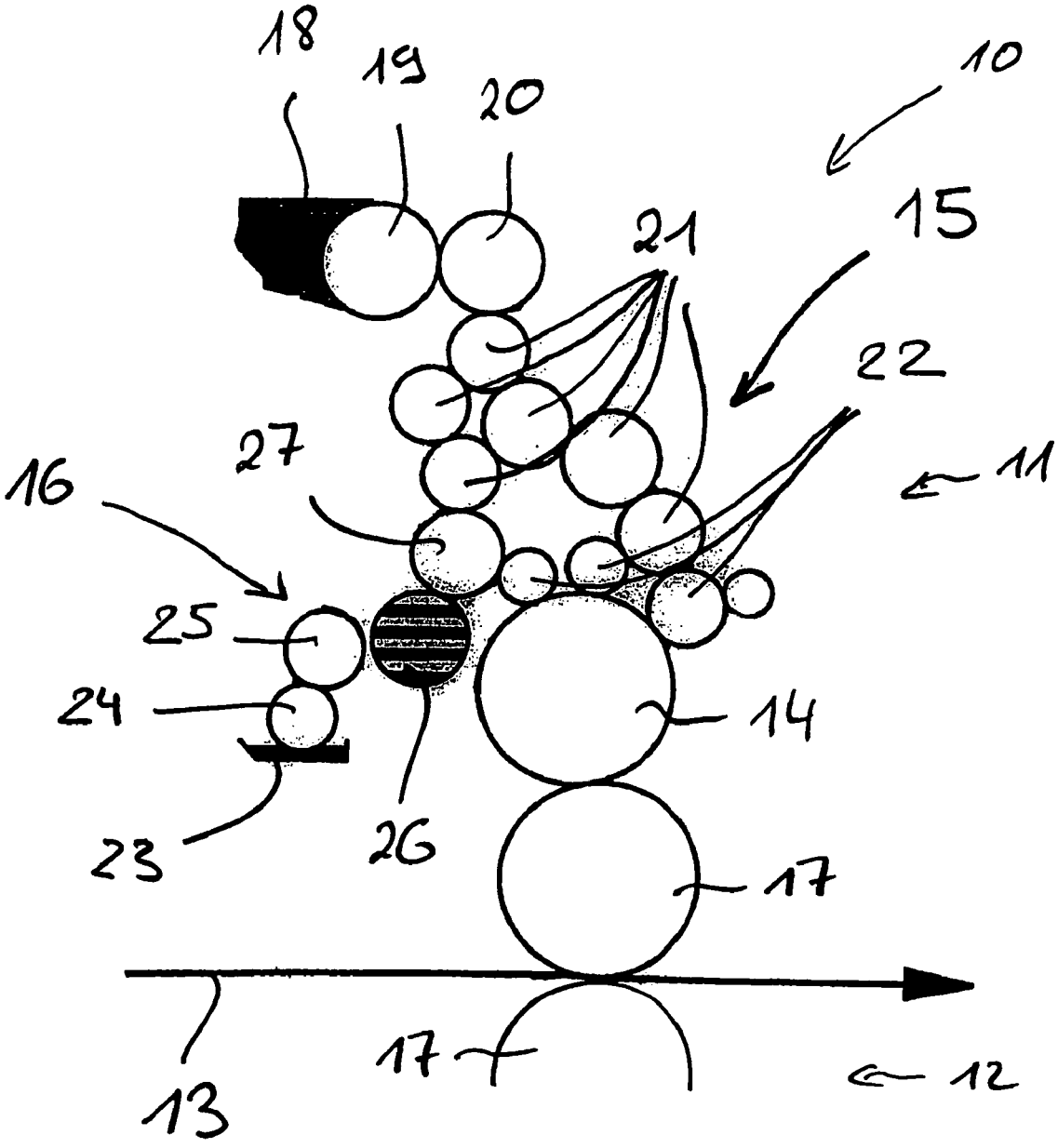
FIG. 3 shows a diagrammatic illustration of the printing unit according to the invention in the print set-up mode.

FIG. 3 shows the printing unit 10 in the print set-up mode with indirect damping-solution supply which is selected by the controller, the damping-solution applicator roll 26 rolling exclusively on the ink distributor roll 27 in this state and being driven by the ink distributor roll 27. If then there is to be a switchover from indirect damping-solution supply to direct damping-solution supply by the controller in the print set-up mode (see FIG. 3), the damping-solution applicator roll 26 is set away from the ink distributor roll 27 more quickly according to the invention than the damping unit 16 and thus the damping-solution applicator roll 26 is set against the form cylinder 14. Accordingly, immediately after the damping-solution applicator roll 26 has been set away from the ink distributor roll 27, a state occurs in which the damping-solution applicator roll 26 rotates freely without contact to another roll. After this freely rotating state of the damping-solution applicator roll 26, the entire damping unit 16 and accordingly the damping-solution applicator roll 26 are accordingly set against the form cylinder 14, in order to assume the state of the printing unit shown in FIG. 2 for direct damping-solution supply.

Figure 4:
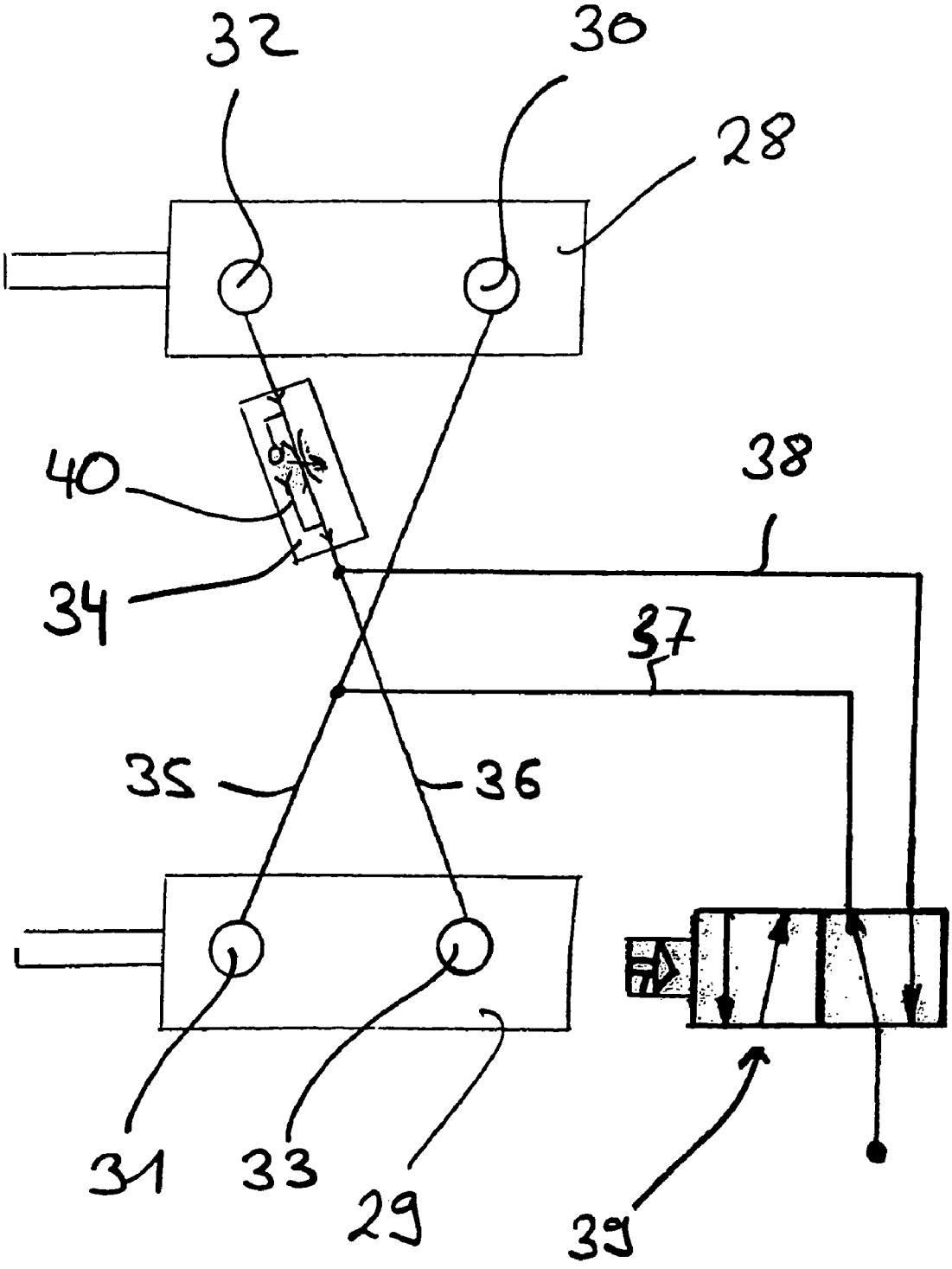
FIG. 4 shows a detail of the printing unit according to the invention.

Furthermore, in terms of the present invention, it is provided that every press unit 11 or 12 of a printing unit 10 has in each case one piston/cylinder system, firstly for displacing the damping-solution applicator roll 26 relative to the ink distributor roll 27 and secondly for displacing the damping unit 16 and therefore the damping-solution applicator roll 26 relative to the form cylinder 14. FIG. 4 shows a first piston/cylinder system 28 for displacing the damping unit 16 and therefore the damping-solution applicator roll 26 relative to the form cylinder 14, and a second piston/cylinder system 29 for displacing the damping-solution applicator roll 26 relative to the ink distributor roll 27. As can be gathered from FIG. 4, the two piston/cylinder systems 28 and 29 are coupled to one another in such a way that a throwing-on connection 30 of the piston/cylinder system 28 for the displacement of the damping unit 16 relative to the form cylinder 14 is coupled to a throwing-off connection 31 of the piston/cylinder system 29 for the displacement of the damping-solution applicator roll 26 relative to the ink distributor roll 27, and that, furthermore, a throwing-off connection 32 of the piston/cylinder system 28 for the displacement of the damping unit 16 relative to the form cylinder 14 is coupled to a throwing-on connection 33 for the displacement of the damping-solution applicator roll 26 relative to the ink distributor roll 27. As can be gathered from FIG. 4, a restrictor 34 is connected here between the throwing-off connection 32 of the piston/cylinder system 28, for the displacement of the damping unit 16 relative to the form cylinder 14, and the throwing-on connection 33 of the piston/cylinder system 29 for the displacement of the damping-solution applicator roll 26 relative to the ink distributor roll 27. As can, furthermore, be gathered from FIG. 4, lines 37 and 38 act on the lines 35 and 36, respectively, which serve to couple the throwing-on connections 30 and 33 to the throwing-off connections 32 and 31, respectively, of the two piston/cylinder systems, which lines 37 and 38 serve as inflow lines or outflow lines as a function of the position of a switchable valve 39. In the preferred exemplary embodiment, the system which is shown in FIG. 4 is configured as a pneumatic system from the piston/cylinder systems 28 and 29; the piston/cylinder systems 28 and 29 are operated by compressed air.

FIG. 4 shows the controllable valve 39 in a position in which it is possible, via the pneumatic piston/cylinder systems 28 and 29 which are coupled to one another, to carry out the abovementioned throwing-on movement of the damping unit 16 and thus of the damping-solution applicator roll 26 onto the form cylinder 14, which throwing-on movement is delayed temporally compared with the throwing-off movement of the damping-solution applicator roll 26 from the ink distributor roll 27. In this case, compressed air is introduced via the line 37 into the line 35 and thus firstly into the throwing-on connection 30 of the piston/cylinder system 28 and also into the throwing-off connection 31 of the piston/cylinder system 29. When compressed air is introduced into the throwing-off connection 31 of the piston/cylinder system 29 for the displacement of the damping-solution applicator roll 26 relative to the ink distributor roll 27, compressed air must accordingly escape via the throwing-on connection 33 and then be ventilated via the lines 36 and 38. The same is true for the piston/cylinder system 28 for the displacement of the damping unit 16 relative to the form cylinder 14, it being possible for the compressed air to escape from the throwing-off connection 32 only in a temporally delayed manner and accordingly more slowly than in the piston/cylinder system 29, as a result of the restrictor 34. This ensures that the damping unit 16 and therefore the damping-solution applicator roll 26 are set against the form cylinder 14 in a temporally delayed manner compared with the throwing-off movement of the damping-solution applicator roll 26 from the ink distributor roll 27.

If the valve 39 assumes the second switching position in which the line 38 serves as a feed line and the line 37 serves as an outlet line for ventilation, it follows directly from the switching diagram in FIG. 4 that the damping-solution applicator roll 26 and the damping unit 16 are set away from the form cylinder 14, and the damping-solution applicator roll 26 is set against the ink distributor roll 27, without a temporal delay as a result of the bypass 40 of the restrictor 34, which bypass 40 is active only in one flow direction.

Accordingly, it is possible in the printing unit according to the invention to throw the damping-solution applicator rolls 26 of the respective press units on and off in such a way that they run nearly always at machine speeds, it being possible at the same time to avoid damage to the damping-solution applicator rolls. Furthermore, a dedicated drive or a gear mechanism for the damping-solution applicator rolls can be dispensed with.

LIST OF REFERENCE NUMERALS

10 Printing unit
11 Press unit
12 Press unit
13 Printing material
14 Form cylinder
15 Inking unit
16 Damping unit
17 Transfer cylinder
18 Ink fountain
19 Ductor roll
20 Film roll
21 Inking roll
22 Ink applicator roll
23 Reservoir
24 Removal roll
25 Roll
26 Damping-solution applicator roll
27 Ink distributor roll
28 Piston/cylinder system
29 Piston/cylinder system
30 Throwing-on connection
31 Throwing-off connection
32 Throwing-off connection
33 Throwing-on connection
34 Restrictor
35 Line
36 Line
37 Line
38 Line
39 Valve
40 Bypass The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A printing unit having a press unit, the press unit having a form cylinder, a transfer cylinder, an inking unit and a damping unit, wherein a printing ink is transferable to the form cylinder via the inking unit and wherein a damping solution is transferable to the form cylinder via the damping unit by way of indirect damping-solution supply in such a way that a damping-solution applicator roll, which is driven by way of friction by an ink distributor roll of the inking unit, rolls on the form cylinder and the ink distributor roll and thus applies the damping solution to the form cylinder, firstly directly via the damping-solution applicator roll and secondly indirectly via an ink applicator roll of the inking unit, and wherein the damping solution is transferable to the form cylinder by way of direct damping-solution supply via the damping unit in such a way that the damping-solution applicator roll, which is set away from the ink distributor roll and is driven by way of friction by the form cylinder, rolls only on the form cylinder and thus applies the damping solution to the form cylinder only directly via the damping-solution applicator roll, and further wherein, in an event of indirect damping-solution supply, which is selected by a controller or a machine and in a print set-up mode, in which the damping-solution applicator roll rolls exclusively on the ink distributor roll and is driven by way of friction by the ink distributor roll, the damping-solution applicator roll is set away from the ink distributor roll more quickly in order to switch over to direct damping-solution supply than the damping unit and thus the damping-solution applicator roll is set against the form cylinder:

wherein the press unit has a first and a second piston/cylinder system which are coupled to one another, firstly for displacing the damping-solution applicator roll relative to the ink distributor roll and secondly for displacing the damping unit and therefore the damping-solution applicator roll relative to the form cylinder;

wherein the piston/cylinder systems are coupled to one another in such a way that a throwing-off connection of the first piston/cylinder system for the displacement of the damping unit or of the damping-solution applicator roll relative to the form cylinder is coupled to a throwing-on connection of the second piston/cylinder system for the displacement of the damping-solution applicator roll relative to the ink distributor roll; and wherein a restrictor is connected between the throwing-off connection of the first piston/cylinder system for the displacement of the damping unit or of the damping-solution applicator roll relative to the form cylinder and the throwing-on connection of the second piston/cylinder system for the displacement of the damping-solution applicator roll relative to the ink distributor roll.

2. The printing unit according to claim 1, wherein the piston/cylinder systems are coupled to one another in such a way that a throwing-on connection of the first piston/cylinder system for the displacement of the damping unit or of the damping-solution applicator roll relative to the form cylinder is coupled to a throwing-off connection of the second piston/cylinder system for the displacement of the damping-solution applicator roll relative to the ink distributor roll.

3. The printing unit according to claim 1, wherein a bypass is connected parallel to the restrictor.

4. The printing unit according to claim 3, wherein, when the damping unit and therefore the damping-solution applicator roll is set against the form cylinder, the bypass is blocked and the restrictor is accordingly active, and wherein, when the damping unit and therefore the damping-solution applicator roll is set away from the form cylinder, the bypass is free and the restrictor is accordingly inactive.

5. The printing unit according to claim 1, wherein the damping-solution applicator roll is drivable exclusively by way of friction without a dedicated drive.

6. The printing unit according to claim 5, wherein, in the event of indirect damping-solution supply, the damping-solution applicator roll is drivable by way of friction by or with the ink distributor roll and, in an event of direct damping-solution supply, is drivable by way of friction by or with the form cylinder.

7. A press unit, comprising:

a form cylinder, a transfer cylinder, an inking unit and a damping unit;

wherein a printing ink is transferable to the form cylinder via the inking unit;

wherein a damping solution is transferable to the form cylinder via the damping unit in an indirect damping-solution supply mode where a damping-solution applicator roll rolls on the form cylinder and an ink distributor roll and in a direct damping-solution supply mode where the damping-solution applicator roll is frictionally driven by. and rolls on, the form cylinder and is set away from the ink distributor roll;

wherein in a switch from the indirect damping-solution supply mode to the direct damping-solution supply mode in a print set-up mode, the damping-solution applicator roll is set away from the ink distributor roll more quickly than the damping-solution applicator roll is set against the form cylinder;

and further comprising a first piston/cylinder system and a second piston/cylinder system coupled to the damping-solution applicator roll;

wherein a throwing-off connection of the first piston/cylinder system is coupled to a throwing-on connection of the second piston/cylinder system; and wherein a restrictor is connected between the throwing-off connection of the first piston/cylinder system and the throwing-on connection of the second piston/cylinder system.

8. The press unit according to claim 7, wherein a throwing-on connection of the first piston/cylinder system is coupled to a throwing-off connection of the second piston/cylinder.

9. The printing unit according to claim 7, wherein a bypass is connected parallel to the restrictor.

* * * * *

UNITED STATES PATENT AND TRADEMARK OFFICE

CERTIFICATE OF CORRECTION

PATENT NO. : 7,607,389 B2
APPLICATION NO. : 11/242429
DATED : October 27, 2009
INVENTOR(S) : Stadlmair et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 944 days.

Signed and Sealed this

Fourteenth Day of December, 2010

David J. Kappos

David J. Kappos
*Director of the United States Patent and Trademark Office*